US010379484B2

(12) United States Patent
Koyama

(10) Patent No.: US 10,379,484 B2
(45) Date of Patent: Aug. 13, 2019

(54) FIXING DEVICE PROVIDED WITH INSULATOR AND RESTRICTION MEMBER SUPPORTING THE SAME

(71) Applicant: BROTHER KOGYO KABUSHIKI KAISHA, Nagoya-shi, Aichi-ken (JP)

(72) Inventor: Tatsuya Koyama, Toyoake (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/665,918

(22) Filed: Aug. 1, 2017

(65) Prior Publication Data

US 2018/0046127 A1 Feb. 15, 2018

(30) Foreign Application Priority Data

Aug. 10, 2016 (JP) ..... 2016-157217

(51) Int. Cl.
*G03G 15/20* (2006.01)
*G03G 15/00* (2006.01)

(52) U.S. Cl.
CPC ..... *G03G 15/80* (2013.01); *G03G 15/2017* (2013.01); *G03G 15/2053* (2013.01)

(58) Field of Classification Search
CPC ..... G03G 15/80; G03G 15/2053
See application file for complete search history.

(56) References Cited

U.S. PATENT DOCUMENTS

2005/0084279 A1* 4/2005 Cho ..... G03G 15/2053 399/90
2005/0232652 A1* 10/2005 Chung ..... G03G 15/2064 399/90
2006/0140690 A1* 6/2006 Ito ..... G03G 15/2053 399/330
2007/0242989 A1 10/2007 Miyake
2012/0308254 A1* 12/2012 Suzuki ..... G03G 15/2053 399/90
2013/0302060 A1* 11/2013 Moriya ..... G03G 21/1652 399/90
2013/0336672 A1* 12/2013 Mizuta ..... G03G 21/1867 399/75
2014/0086612 A1* 3/2014 Cheong ..... G03G 15/2053 399/90

(Continued)

FOREIGN PATENT DOCUMENTS

JP 2007-310377 A 11/2007

*Primary Examiner* — Sevan A Aydin
(74) *Attorney, Agent, or Firm* — Merchant & Gould P.C.

(57) ABSTRACT

A fixing device includes: a rotary body, a heater having one end and another end, a first power supply cord having one end portion connected to the one end of the heater, a first insulator, a second power supply cord having one end portion connected to the other end of the heater, a second insulator, a support frame, and a restriction member. The first insulator holds both the one end of the heater and the one end portion of the first power supply cord. The second insulator holds both the other end of the heater and the one end portion of the second power supply cord. The support frame includes a first support portion supporting the first insulator and a second support portion supporting the second insulator. The restriction member is detachably attachable to the support frame and restricts movement of the first insulator in a first direction.

19 Claims, 7 Drawing Sheets

(56) References Cited

U.S. PATENT DOCUMENTS

| | | | | |
|---|---|---|---|---|
| 2014/0133884 | A1* | 5/2014 | Toyoda | G03G 15/751 399/111 |
| 2015/0093161 | A1* | 4/2015 | Takeuchi | G03G 15/2053 399/328 |
| 2015/0104227 | A1* | 4/2015 | Shimokawa | G03G 15/2053 399/329 |
| 2015/0139680 | A1* | 5/2015 | Moriya | G03G 21/1652 399/90 |
| 2015/0139681 | A1* | 5/2015 | Mizuta | G03G 21/1867 399/90 |
| 2015/0160591 | A1* | 6/2015 | Hase | G03G 15/2053 399/329 |
| 2016/0033909 | A1* | 2/2016 | Kondo | G03G 15/2053 399/330 |
| 2016/0147185 | A1* | 5/2016 | Hase | G03G 15/2053 399/329 |
| 2016/0252855 | A1* | 9/2016 | Ishida | G03G 15/2053 399/329 |
| 2016/0266528 | A1* | 9/2016 | Saiki | G03G 15/2053 |
| 2017/0090367 | A1* | 3/2017 | Kajita | G03G 15/2053 |
| 2017/0090369 | A1* | 3/2017 | Aiba | G03G 15/2053 |
| 2017/0336749 | A1* | 11/2017 | Ando | G03G 15/80 |
| 2018/0046127 | A1* | 2/2018 | Koyama | G03G 15/2053 |
| 2018/0107141 | A1* | 4/2018 | Aiba | G03G 15/2053 |

* cited by examiner

FIXING DEVICE PROVIDED WITH INSULATOR AND RESTRICTION MEMBER SUPPORTING THE SAME

CROSS REFERENCE TO RELATED APPLICATION

This application claims priority from Japanese Patent Application No. 2016-157217 filed Aug. 10, 2016. The entire content of the priority application is incorporated herein by reference.

TECHNICAL FIELD

The present disclosure relates to a fixing device.

BACKGROUND

There has been known a fixing device provided in a printer or a copying machine. Japanese Patent Application Publication No. 2007-310377 discloses a fixing device including a hollow cylindrical rotary body, a heat member such as a tubular heater positioned at an inner space of the rotary body and extending in an axial direction of the rotary body (i.e., direction of a rotational axis of the rotary body), a first insulator, a second insulator and a support frame. The first insulator and the second insulator are made from glass and hold one end portion and another end portion of the heat member in the axial direction, respectively. The support frame includes a first support wall supporting the first insulator and in contact with one side surface of the first insulator in the axial direction, and a second support wall supporting the second insulator and in contact with another side surface of the second insulator in the axial direction. With this structure, the heat member is supported so as not to move in the axial direction. That is, movement of the heat member in the axial direction is restricted by the support frame.

SUMMARY

According to one aspect, the disclosure provides a fixing device including: a rotary body, a heater, a first power supply cord, a first insulator, a second power supply cord, a second insulator, a support frame, and a restriction member. The rotary body has a hollow cylindrical shape and a rotational axis extending in a first direction. The heater is positioned inside the rotary body and has a tubular shape. The heater extends in the first direction and has one end and another end. The first power supply cord has one end portion connected to the one end of the heater. The first insulator is configured to hold both the one end of the heater and the one end portion of the first power supply cord. The first insulator has a plurality of outer peripheral surfaces including one surface through which the one end of the heater is inserted. The second power supply cord has one end portion connected to the other end of the heater. The second insulator is configured to hold both the other end of the heater and the one end portion of the second power supply cord. The second insulator has a plurality of outer peripheral surfaces including: a first surface through which the other end of the heater is inserted, and a second surface positioned opposite to the first surface with respect to a connecting portion between the other end of the heater and the second power supply cord. The support frame includes: a first support portion, and a second support portion. The first support portion supports the first insulator. The first support portion is configured to support the plurality of outer peripheral surfaces of the first insulator except the one surface. The second support portion supports the second insulator. The second support portion is configured to support the plurality of outer peripheral surfaces of the second insulator except both the first surface and the second surface. The restriction member has one side wall positioned between the rotary body and the one surface of the first insulator. The restriction member is configured to be detachably attached to the support frame and to restrict movement of the first insulator in the first direction. The one side wall has at least a portion overlapped with the one surface as viewed in the first direction.

According to another aspect, the disclosure provides a fixing device including: a rotary body, a heater, a power supply cord, an insulator, a support frame, and a cover member. The rotary body has a hollow cylindrical shape and a rotational axis extending in a first direction. The heater is positioned inside the rotary body and has a tubular shape. The heater extends in the first direction and has one end and another end. The power supply cord has one end portion connected to the one end of the heater. The insulator is configured to hold both the one end of the heater and the one end portion of the power supply cord. The insulator has a plurality of outer peripheral surfaces including: one surface through which the one end of the heater is inserted, and another surface parallel to the one surface. The support frame includes a supporting recess receiving the plurality of outer peripheral surfaces of the first insulator except both the one surface and the another surface. The cover member is configured to be detachably attached to the support frame and to support the first insulator in cooperation with the supporting recess. The cover member includes: one side wall, and another side wall. The one side wall is positioned between the rotary body and the one surface of the insulator. The one side wall has at least a portion overlapped with the one surface as viewed in the first direction. The another side wall contacts the another surface.

According to still another aspect, the disclosure provides an image forming apparatus including: a main frame, and a fixing device. The fixing device is attached to the main frame. The fixing device includes: a rotary body, a heater, a first power supply cord, a first insulator, a second power supply cord, a second insulator, a support frame, and a restriction member. The rotary body has a hollow cylindrical shape and a rotational axis extending in a first direction. The heater is positioned inside the rotary body and has a tubular shape. The heater extends in the first direction and has one end and another end. The first power supply cord has one end portion connected to the one end of the heater. The first insulator is configured to hold both the one end of the heater and the one end portion of the first power supply cord. The first insulator has a plurality of outer peripheral surfaces including one surface through which the one end of the heater is inserted. The second power supply cord has one end portion connected to the other end of the heater. The second insulator is configured to hold both the other end of the heater and the one end portion of the second power supply cord. The second insulator has a plurality of outer peripheral surfaces including: a first surface through which the other end of the heater is inserted, and a second surface positioned opposite to the first surface with respect to a connecting portion between the other end of the heater and the second power supply cord. The support frame includes: a first support portion, and a second support portion. The first support portion supports the first insulator. The first support portion is configured to support the plurality of outer peripheral surfaces of the first insulator except the one surface. The second support portion supports the second insulator. The second support portion is configured to support the plurality of outer peripheral surfaces of the second insulator except both the first surface and the second surface. The restriction member has one side wall positioned between the rotary body and the one surface of the first insulator. The restriction member is configured to be detachably attached to the support frame and to restrict movement of the first insulator in the first direction. The one side wall has at least a portion overlapped with the one surface as viewed in the first direction.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

A printer 10 provided with a fixing device 700 according to one embodiment will be described with reference to FIG. 1.

Figure 1:
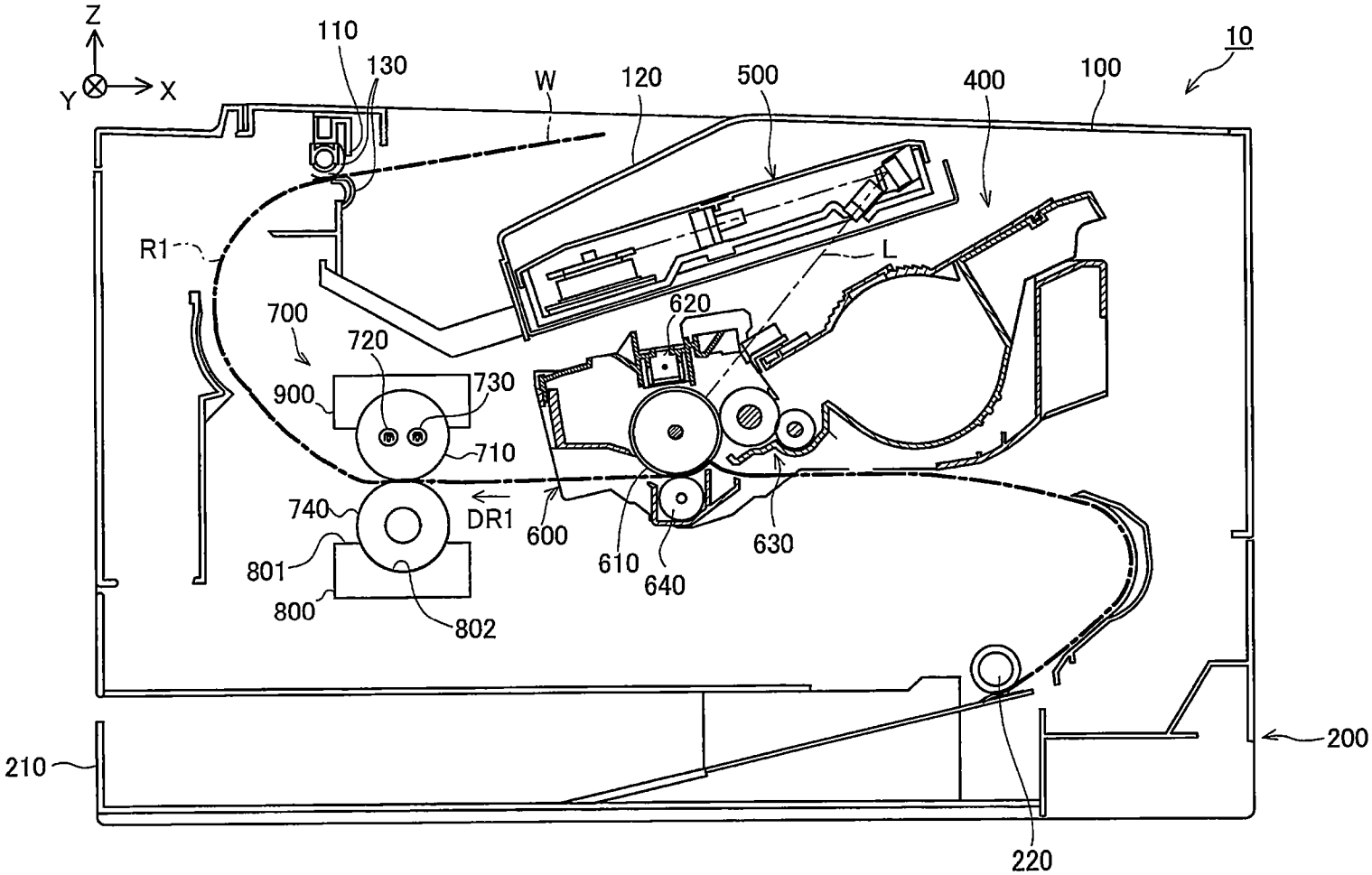
FIG. 1 is a schematic view illustrating an overall structure of a printer in which a fixing device according to one embodiment of the present disclosure is provided.

In FIG. 1, X-axis, Y-axis, and Z-axis perpendicular to each other are illustrated to specify directions. In the following description, for the purpose of convenience, it is assumed that a positive Z-axis direction is defined as an upward direction for specifying an upper side of the printer 10, a negative Z-axis direction is defined as a downward direction for specifying a lower side of the printer 10, a positive X-axis direction is defined as a forward direction for specifying a front side of the printer 10, a negative X-axis direction is defined as a rearward direction for specifying a rear side of the printer 10, a positive Y-axis direction is defined as a rightward direction for specifying a right side of the printer 10, and a negative Y-axis direction is defined as a leftward direction for specifying a left side of the printer 10. The same applies to the drawings subsequent to FIG. 1.

The printer 10 is an electro-photographic type printer capable of forming an image on a sheet W such as a recording sheet or an OHP sheet using toner (developing agent) of single color, for example, black color.

As illustrated in FIG. 1, the printer 10 includes a housing 100, a sheet supply section 200, and an image forming section 400. The housing 100 accommodates the sheet supply section 200 and the image forming section 400 therein. The housing 100 has an upper wall formed with a discharge opening 110 and a discharge tray 120. Discharge rollers 130 are provided at a position adjacent to the discharge opening 110. The printer 10 is an example of an image forming apparatus, and the housing 100 is an example of a main frame.

The sheet supply section 200 includes a sheet tray 210, and a pick-up roller 220. The sheet tray 210 accommodates sheets W therein. The pick-up roller 220 is adapted to pick up each one of the sheets W accommodated in the sheet tray 210 and to supply each sheet W toward the image forming section 400.

The image forming section 400 includes an exposure portion 500, a process portion 600, and a fixing device 700. The process portion 600 includes a photosensitive body 610, a charger 620, a developing portion 630, and a transfer roller 640. The exposure portion 500 irradiates the photosensitive body 610 with a laser beam L (light beam).

The charger 620 is adapted to uniformly charge a surface of the photosensitive body 610. An electrostatic latent image is formed on the surface of the photosensitive body 610 by the irradiation with the laser beam L from the exposure portion 500 onto the surface of the photosensitive body 610 which has been charged by the charger 620. The electrostatic latent image is developed into a toner image as a result of supplying toner onto the surface of the photosensitive body 610 by the developing portion 630. The toner image formed on the surface of the photosensitive body 610 is transferred by the transfer roller 640 onto the sheet W passing through a portion between the photosensitive body 610 and the transfer roller 640.

The fixing device 700 is adapted to fix the toner image transferred onto the sheet W to the sheet W by heating the sheet W that has been passed through the process portion 600. Accordingly, an image is formed on the sheet W. Details of the fixing device 700 will be described later. The discharge rollers 130 are adapted to discharge the sheet W that has been passed through the fixing device 700 onto the discharge tray 120 through the discharge opening 110. In the following description, a conveyance path of the sheet W from the sheet supply section 200 to the discharge rollers 130 will be referred to as a sheet conveying passage R1.

The fixing device 700 will next be described. As illustrated in FIG. 1, the fixing device 700 includes a heat roller 710, a first heater 720, a second heater 730 those accommodated in the heat roller 710, an upper cover 900 covering an upper side of the heat roller 710, a pressure roller 740 positioned below the heat roller 710, and a lower cover 800 covering a lower side of the pressure roller 740.

Right cords 770, a right insulator 760, and a right cover member 950 (FIG. 3) are positioned at a right end of the upper cover 900. Left cords 790, a left insulator 780, and a left cover member 960 (FIG. 5) are positioned at a left end of the upper cover 900.

Figure 2:
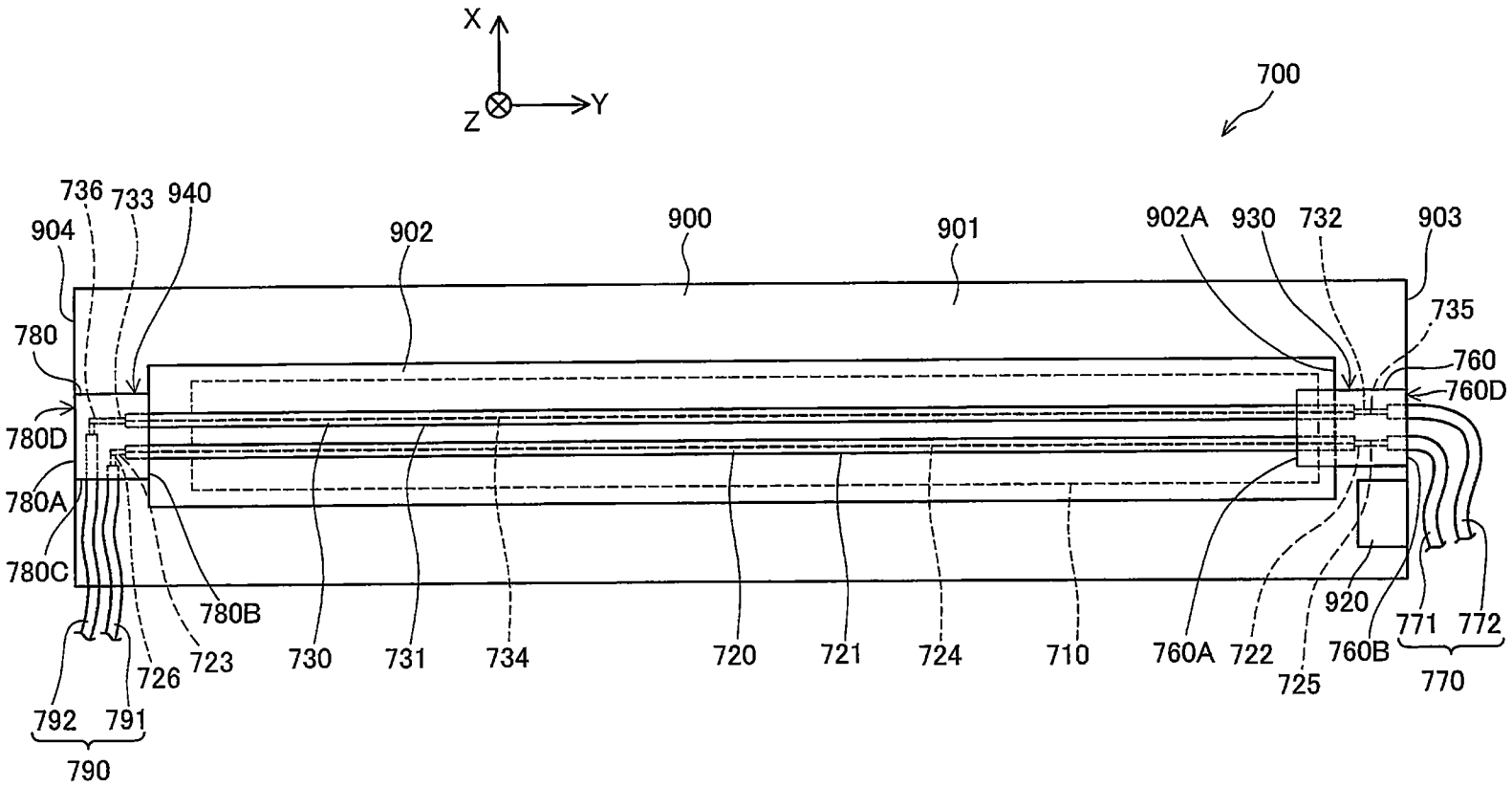
FIG. 2 is a bottom view illustrating an upper cover, a first heater and a second heater in the fixing device according to the embodiment.

As illustrated in FIGS. 1 and 2, the heat roller 710 is a hollow cylindrical member elongated in the rightward/leftward direction. The heat roller 710 is rotatable about a rotational axis approximately parallel to the rightward/leftward direction. Incidentally, the heat roller 710 is an example of a rotary body, and the rightward/leftward direction is an example of a first direction.

The first heater 720 and the second heater 730 are tubular heating members, for example, halogen heaters. The first heater 720 and the second heater 730 are disposed in the inner space of the heat roller 710. Longitudinal directions of the first heater 720 and the second heater 730 are coincident with the rotational axis of the heat roller 710. Further, the first heater 720 and the second heater 730 are arrayed in the frontward/rearward direction such that the second heater 730 is positioned frontward of the first heater 720. The first heater 720 and the second heater 730 are examples of a heater and another heater.

As illustrated in FIG. 2, the first heater 720 includes a first glass tube 721, a first heat element 724, a first right lead pin 722, and a first left lead pin 723. The first heat element 724 is a linear metal wire, specifically, a filament. The first heat element 724 is positioned inside the first glass tube 721 and extends in the rightward/leftward direction. The first right lead pin 722 is a terminal member made from metal, and has one end portion electrically connected to the first heat element 724 and another end portion protruding rightward from a right end of the first glass tube 721. The first left lead pin 723 is a terminal member made from metal, and has one end portion electrically connected to the first heat element 724 and another end portion protruding leftward from a left end of the first glass tube 721.

The second heater 730 includes a second glass tube 731, a second heat element 734, a second right lead pin 732, and a second left lead pin 733. Each component of the second heater 730 is the same as each corresponding component of the first heater 720, and therefore, further description is omitted to avoid duplicating description.

The right cords 770 are electrically conductive wires that are elastically deformable, and include a first right cord 771 and a second right cord 772. The first right cord 771 has one end portion electrically connected to the first right lead pin 722 of the first heater 720. The second right cord 772 has one end portion electrically connected to the second right lead pin 732 of the second heater 730. Another end portion of the first right cord 771 and another end portion of the second right cord 772 are electrically connected to a power source (not illustrated) for supplying electric power to the first heater 720 and the second heater 730. The first right cord 771 and the second right cord 772 are examples of a second power supply cord. The first right cord 771 and the second right cord 772 are also examples of a second power supply cord and a fourth power supply cord, respectively.

The right insulator 760 is a heat resistant member having a generally rectangular parallelepiped shape, and having a left surface 760A, a right surface 760B and an upper surface 760D. The right insulator 760 is adapted to hold a connecting portion 725 between the first heater 720 and the first right cord 771, and a connecting portion 735 between the second heater 730 and the second right cord 772. Specifically, the first right lead pin 722 of the first heater 720, the one end portion of the first right cord 771, the second right lead pin 732 of the second heater 730, and the one end portion of the second right cord 772 are embedded in an interior of the right insulator 760. The right surface 760B is positioned opposite to the left surface 760A with respect to the connecting portion 725 and the connecting portion 735.

The first heater 720 and the second heater 730 extend leftward from the left surface 760A of the right insulator 760. In other words, another ends of the first heater 720 and the second heater 730 are inserted through the left surface 760A of the right insulator 760. The right cords 770 extend rightward from the right surface 760B of the right insulator 760 that is farthest from the first heater 720 and the second heater 730 in the rightward/leftward direction among outer surfaces of the right insulator 760. Incidentally, the right insulator 760 is an example of a second insulator, the left surface 760A is an example of a first surface, and the right surface 760B is an example of a second surface.

The left cords 790 are electrically conductive wires that are elastically deformable, and include a first left cord 791 and a second left cord 792. Each component of the left cords 790 is the same as each corresponding component of the right cords 770, and therefore, further description is omitted to avoid duplicating description. The first left cord 791 and the second left cord 792 are examples of a first power supply cord. The first left cord 791 and the second left cord 792 are also examples of a first power supply cord and a third power supply cord, respectively. The first left cord 791 and the second left cord 792 are also an example of a power supply cord.

The left insulator 780 is a heat resistant member having a generally rectangular parallelepiped shape, and having a left surface 780A, a right surface 780B, a rear surface 780C, and an upper surface 780D. The left insulator 780 is adapted to hold a connecting portion 726 between the first heater 720 and the first left cord 791, and a connecting portion 736 between the second heater 730 and the second left cord 792.

The first heater 720 and the second heater 730 extend rightward from the right surface 780B of the left insulator 780. In other words, one ends of the first heater 720 and the second heater 730 are inserted through the right surface 780B of the left insulator 780. The left cords 790 extend rearward from the rear surface 780C of the left insulator 780. In other words, the left cords 790 extend outward of the heat roller 710 in a radial direction of the heat roller 710. Incidentally, the left insulator 780 is an example of a first insulator, the left surface 780A is an example of another surface, the right surface 780B is an example of one surface, and the rear surface 780C is an example of a connecting surface. The left insulator 780 is also an example of an insulator.

The first heater 720, the second heater 730, and the right cords 770 are integrally held by the right insulator 760, and the first heater 720, the second heater 730, and the left cords 790 are integrally held by the left insulator 780. Accordingly, the first heater 720, the second heater 730, the right cords 770, the right insulator 760, the left cords 790, and the left insulator 780 are integrally attached to and detached from the upper cover 900.

As illustrated in FIGS. 1 and 2, the upper cover 900 has a flat plate shape elongated in the rightward/leftward direction. The upper cover 900 is made of resin. Details of the upper cover 900 will be described later.

As illustrated in FIG. 1, the pressure roller 740 is a solid cylindrical member whose longitudinal direction is coincident with the rightward/leftward direction. The pressure roller 740 is positioned opposite to the heat roller 710 with respect to the sheet conveying passage R1 such that the pressure roller 740 contacts the heat roller 710. The pressure roller 740 is rotatable about a rotational axis approximately parallel to the rightward/leftward direction. The pressure roller 740 is urged toward the heat roller 710 to provide a nip region therebetween.

By the rotation of the heat roller 710 and the pressure roller 740, the sheet W is conveyed in the fixing device 700 from the front side toward the rear side. That is, a sheet conveying direction of the sheet W in the fixing device 700 (hereinafter called a "sheet conveying direction DR1") is approximately coincident with the rearward direction. The sheet conveying direction DR1 is perpendicular to the rightward/leftward direction and a direction in which the heat roller 710 and the pressure roller 740 face to each other. The sheet conveying direction DR1 is an example of a second direction.

The lower cover 800 has a flat plate shape extending in the longitudinal direction of the pressure roller 740, and is made from resin. The lower cover 800 has an upper surface 801 facing the pressure roller 740. An accommodation groove 802 extending in the longitudinal direction of the pressure roller 740 is formed in the upper surface 801. The accommodation groove 802 is arcuate in shape as viewed in the rightward/leftward direction, and is adapted to receive a lower portion of the pressure roller 740.

As illustrated in FIG. 2, the upper cover 900 has a lower surface 901 facing the heat roller 710, a right end surface 903, and a left end surface 904. The right end surface 903 and the left end surface 904 extend in directions perpendicular to the rightward/leftward direction. An accommodation groove 902 extending in the rightward/leftward direction is formed in the lower surface 901 at an intermediate position in the rightward/leftward direction. The accommodation groove 902 is arcuate in shape as viewed in the rightward/leftward direction. The accommodation groove 902 accommodates an upper portion of the heat roller 710. Incidentally, the upper cover 900 is an example of a support frame.

Figure 3:
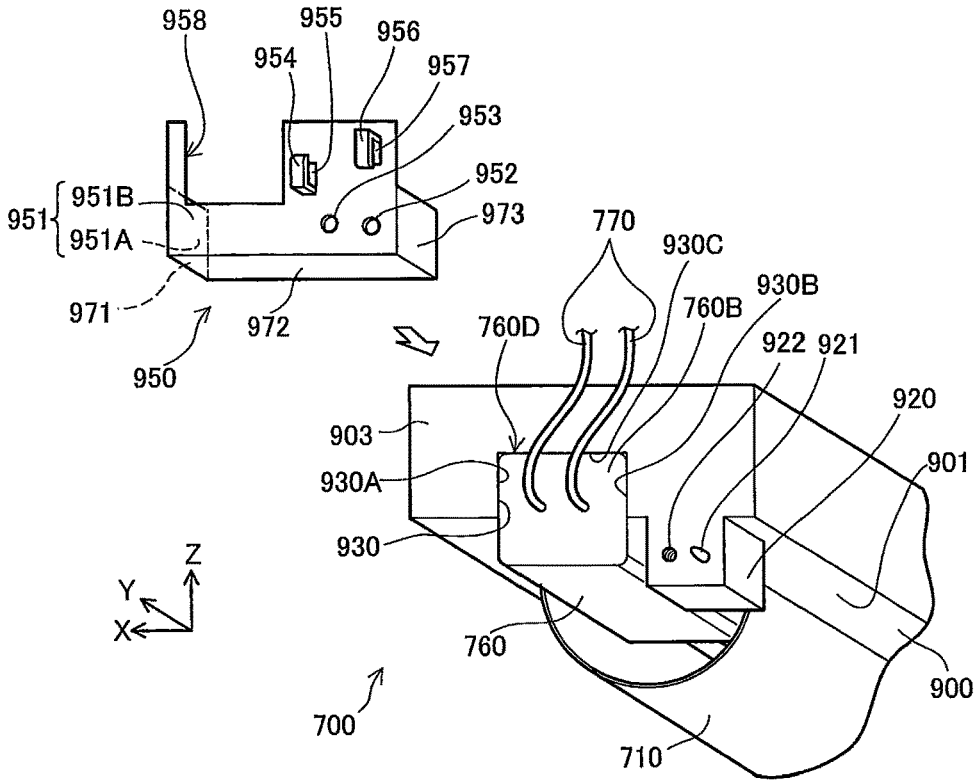
FIG. 3 is a perspective view, as viewed from a right side, illustrating a right side portion of the upper cover, a heat roller, a right insulator, and a right cover member detached from the upper cover in the fixing device according to the embodiment.
Figure 4:
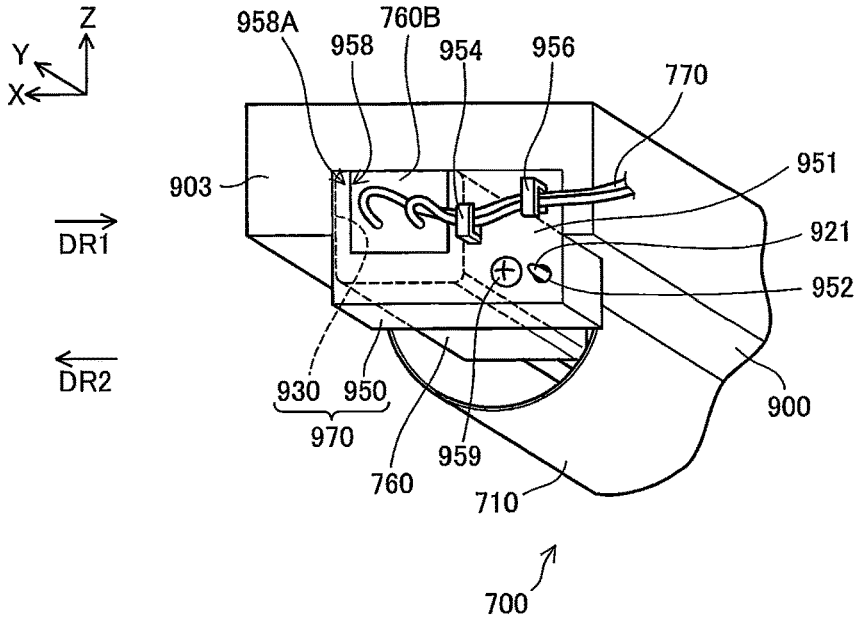
FIG. 4 is a perspective view, as viewed from the right side, illustrating the right side portion of the upper cover, the heat roller, and the right cover member attached to the upper cover in the fixing device according to the embodiment.

As illustrated in FIGS. 2 through 4, the lower surface 901 of the upper cover 900 has a right end portion formed with a right supporting recess 930, and provided with a fixing stand 920 having a generally rectangular parallelepiped shape. The right supporting recess 930 is formed at a position between the accommodation groove 902 and the right end surface 903. Specifically, the right supporting recess 930 extends along the rotational axis of the heat roller 710 from an inner surface 902A constituting the accommodation groove 902 to the right end surface 903 of the upper cover 900. The right supporting recess 930 is generally rectangular shaped having a front surface 930A, a rear surface 930B, and an upper surface 930C as viewed in the rightward/leftward direction.

The right supporting recess 930 receives an upper portion of the right insulator 760. The right supporting recess 930 has a dimension in the frontward/rearward direction approximately equal to a dimension of the right insulator 760 in the frontward/rearward direction. Further, the right insulator 760 is disposed so as not to be overlapped with the upper cover 900 as viewed in the rightward/leftward direction. Therefore, the right insulator 760 is movable in the rightward/leftward direction in a state where the right insulator 760 is received in the right supporting recess 930.

An upper portion of a front surface of the right insulator 760 is in contact with the front surface 930A of the right supporting recess 930. An upper portion of a rear surface of the right insulator 760 is in contact with the rear surface 930B of the right supporting recess 930. The upper surface 760D of the right insulator 760 is in contact with the upper surface 930C of the right supporting recess 930. Accordingly, each surface (i.e., the front surface, the rear surface, and the upper surface 760D) of the right insulator 760 is supported by the right supporting recess 930. Incidentally, the right supporting recess 930, the fixing stand 920 and a portion of the upper cover 900 ambient thereto are examples of a second support portion.

The right surface 760B of the right insulator 760 is disposed so as to be flush with the right end surface 903 of the upper cover 900. On the other hand, a left side portion of the right insulator 760 protrudes toward the accommodation groove 902 of the upper cover 900, and is positioned inside the heat roller 710 received in the accommodation groove 902.

The fixing stand 920 has a generally rectangular parallelepiped shape, and protrudes downward from the lower surface 901 of the upper cover 900 at a position diagonally rearward and downward of the right supporting recess 930. A right end surface of the fixing stand 920 constitutes a part of the right end surface 903 of the upper cover 900.

As illustrated in FIG. 3, the part of the right end surface 903 constituting the fixing stand 920 has a protrusion 921 and a fixing hole 922. The protrusion 921 protrudes rightward from the right end surface 903 of the upper cover 900. The fixing hole 922 is a thread hole for fixing the right cover member 950 to the upper cover 900, and is positioned frontward of the protrusion 921.

The right cover member 950 is detachable from and attachable to the upper cover 900. The right cover member 950 covers a lower portion of the right insulator 760 in a state where the right cover member 950 is attached to the upper cover 900. The right cover member 950 includes a front wall 971, a lower wall 972, a rear wall 973, and a right wall 951. The front wall 971 covers a lower portion of the front surface of the right insulator 780 received in the right supporting recess 930 in an attachment state of the right cover member 950 to the upper cover 900. The lower wall 972 covers a lower surface of the fixing stand 920 and a lower surface of the right insulator 760. The rear wall 973 covers a lower portion of a rear surface of the fixing stand 920. The right wall 951 covers a right surface of the fixing stand 920 and the right surface 760B of the right insulator 760.

The right wall 951 is positioned rightward of a right end of the heat roller 710 in the attachment state of the right cover member 950 to the upper cover 900. More specifically, the right wall 951 is positioned opposite to the right end of the heat roller 710 with respect to the right insulator 760. The right wall 951 has an inner surface 951A and an outer surface 951B. In the attachment state of the right cover member 950 to the upper cover 900, the inner surface 951A is positioned at a side the same as that of the first heater 720 and the second heater 730, and the outer surface 951B is positioned at a side opposite to the side of the first heater 720 and the second heater 730. In a state where the right cover member 950 is attached to the upper cover 900, the right wall 951 extends parallel to the right surface 760B of the right insulator 760 and contacts the right wall 760B, and the right supporting recess 930 formed at the upper cover 900 is positioned at the side the same as that of the inner surface 951A of the right wall 951. In the following description, the right cover member 950 is assumed to be attached to the upper cover 900 unless otherwise noted. Incidentally, the right cover member 950 is an example of another restriction member, and the right wall 951 is an example of a side wall of the another restriction member.

The right wall 951 has an opening 958, a first hook 954, a second hook 956, a regulation hole 952, and a through-hole 953.

The opening 958 extends through the right wall 951 extending in the rightward/leftward direction from the inner surface 951A to the outer surface 951B, and has a notched shape with an upper side open. As illustrated in FIG. 4, the opening 958 is aligned with the right insulator 760 in the rightward/leftward direction. Specifically, the opening 958 is formed so as to be overlapped with base ends of the right cords 770 extending from the right surface 760B of the right insulator 760. The opening 958 has a dimension in the frontward/rearward direction smaller than a dimension in the frontward/rearward direction of the right surface 760B of the right insulator 760. Further, the opening 958 has a dimension in the upward/downward direction smaller than a dimension in the upward/downward direction of the right surface 760B of the right insulator 760. With this structure, an ambient portion 958A of the opening 958 of the right wall 951 is overlapped with the right insulator 760 as viewed in the rightward/leftward direction at a position rightward of the right insulator 760. That is, at least a portion of the right wall 951 is overlapped with the right surface 760B as viewed in the rightward/leftward direction. Accordingly, rightward movement of the right insulator 760 is restricted.

The first hook 954 and the second hook 956 are provided at the outer surface 951B of the right wall 951 at a position rearward of the opening 958. In other words, the first hook 954 and the second hook 956 are positioned at a downstream side of the right insulator 760 in the sheet conveying direction DR1 in the fixing device 700 of the sheet W in a state where the right cover member 950 is attached to the upper cover 900. The first hook 954 has an L-shape bent upward relative to the outer surface 951B of the right wall 951. Specifically, the first hook 954 includes a first relay portion extending rightward from the outer surface 951B and a first tip end portion extending upward from a right end of the first relay portion. Thus, the first hook 954 and the outer surface 951B of the right wall 951 define therebetween a gap 955 open in the frontward/rearward direction and upward. The second hook 956 has an L-shaped bent downward relative to the outer surface 951B of the right wall 951. Specifically, the second hook 956 includes a second relay portion extending rightward from the outer surface 951B and a second tip end portion extending downward from a right end of the second relay portion. Thus, the second hook 956 and the outer surface 951B of the right wall 951 define therebetween a gap 957 open in the frontward/rearward direction and downward. The first hook 954 and the second hook 956 is an example of a hook.

The regulation hole 952 and the through-hole 953 extend through the right wall 951 in the rightward/leftward direction from the inner surface 951A to the outer surface 951B. As illustrated in FIG. 3, the regulation hole 952 and the through-hole 953 are positioned diagonally rearward and downward of the opening 958. The regulation hole 952 is overlapped with the protrusion 921 of the upper cover 900 as viewed in the rightward/leftward direction, and the through-hole 953 is overlapped with the fixing hole 922 of the upper cover 900 as viewed in the rightward/leftward direction.

The right cover member 950 is attached to the upper cover 900 from the right side of the upper cover 900 along the protrusion 921 of the upper cover 900 during attachment of the right cover member 950 to the upper cover 900. Accordingly, the protrusion 921 of the upper cover 900 is fitted with the regulation hole 952 of the right wall 951, and thus the right cover member 950 is attached to the upper cover 900 so as not to be moved relative to the upper cover 900 in the frontward/rearward direction and upward/downward direction. The regulation hole 952 is an example of a hole.

The right cords 770 extending from the right surface 760B of the right insulator 760 are drawn to an outer side of the outer surface 951B of the right wall 951 through the opening 958 of the right wall 951. After the right cords 770 are drawn to the outer side of the outer surface 951B, the right cords 770 are inserted into the first hook 954 from above and is engaged with the same, and then inserted into the second hook 956 from below and is engaged with the same. That is, the right cords 770 are drawn with respect to the right insulator 760 in a direction opposite to an attachment direction DR2 described later by permitting the right cords 770 to be engaged with the first hook 954 and the second hook 956 positioned rearward (i.e., upstream side in the attachment direction DR2) of the right insulator 760. After the right cover member 950 has been attached to the upper cover 900, the right cover member 950 is fixed to the upper cover 900 by a screw 959 extending through the through-hole 953 and fastened to the fixing hole 922.

The right insulator 760 is supported such that the upper end portion of the right insulator 760 is received in the right supporting recess 930 of the upper cover 900, and the lower end portion of the right insulator 760 is covered by the right cover member 950. That is, the right insulator 760 is supported by being positioned between the upper cover 900 and the right cover member 950 in the upward/downward direction. Therefore, the right supporting recess 930, the portion of the upper cover 900 ambient to the right supporting recess 930, and the right cover member 950 constitute in combination a support portion 970 (see FIG. 4) for supporting the right insulator 760.

Figure 5:
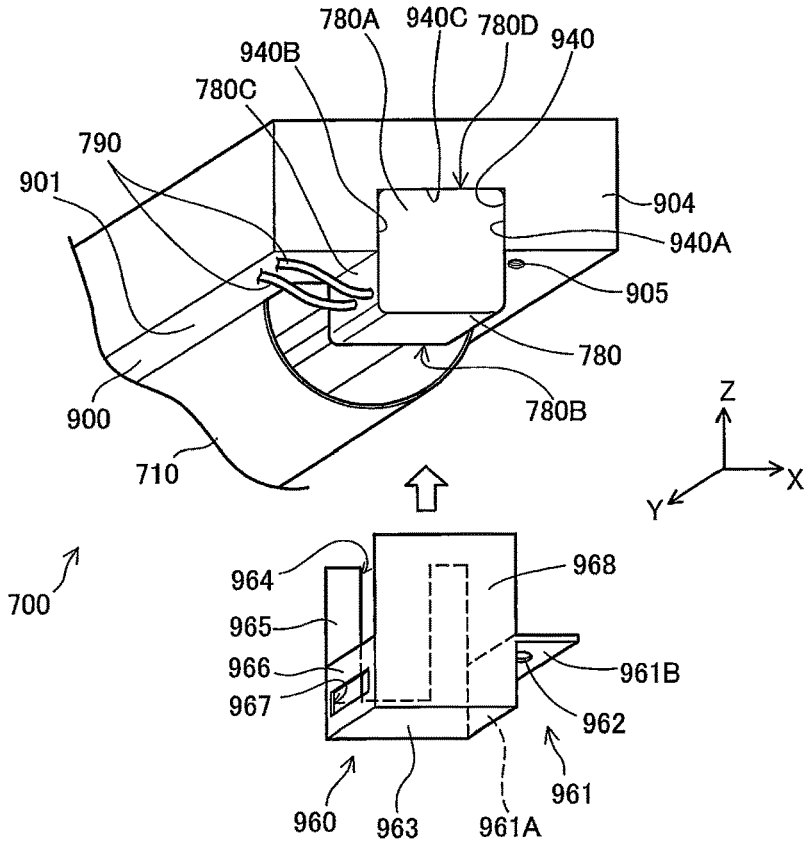
FIG. 5 is a perspective view, as viewed from a left side, illustrating a left side portion of the upper cover, the heat roller, a left insulator, and a left cover member detached from the upper cover in the fixing device according to the embodiment.

As illustrated in FIGS. 2, and 5 through 7, the lower surface 901 of the upper cover 900 has a left end portion formed with a left supporting recess 940, and a fixing hole 905 (see FIG. 5). The fixing hole 905 is a thread hole for fixing the left cover member 960 to the upper cover 900, and is positioned frontward of the left supporting recess 940.

The left supporting recess 940 is positioned between the accommodation groove 902 and the left end surface 904, and leftward of a left end of the heat roller 710 received in the accommodation groove 902. More specifically, the left supporting recess 940 extends in the longitudinal direction of the first heater 720 and the second heater 730 from the inner surface 902A constituting the accommodation groove 902 to the left end surface 904 of the upper cover 900. The left supporting recess 940 is generally rectangular shaped having a front surface 940A, a rear surface 940B, and an upper surface 940C as viewed in the rightward/leftward direction.

The left supporting recess 940 receives an upper portion of the left insulator 780. The left supporting recess 940 has a dimension in the frontward/rearward direction approximately equal to a dimension of the left insulator 780 in the frontward/rearward direction. Further, the left insulator 780 is disposed so as not to be overlapped with the upper cover 900 as viewed in the rightward/leftward direction. Accordingly, the left insulator 780 is movable in the rightward/leftward direction in a state where the left insulator 780 is received in the left supporting recess 940. The left supporting recess 940 is an example of a supporting recess.

An upper portion of a front surface of the left insulator 780 is in contact with the front surface 940A of the left supporting recess 940. An upper portion of the rear surface 780C of the left insulator 780 is in contact with the rear surface 940B of the left supporting recess 940. The upper surface 780D of the left insulator 780 is in contact with the upper surface 940C of the left supporting recess 940. Thus, each surface (i.e., the front surface, the rear surface 780C and the upper surface 780D) of the left insulator 780 is supported by the left supporting recess 940. Incidentally, the left supporting recess 940, the fixing hole 905 and a portion of the upper cover 900 ambient thereto are examples of a first support portion.

The left surface 780A of the left insulator 780 is disposed so as to be flush with the left end surface 904 of the upper cover 900. Further, the right surface 780B of the left insulator 780 is disposed so as to be flush with the inner surface 902A constituting the accommodation groove 902. Therefore, the entire left insulator 780 is positioned leftward of the left end of the heat roller 710 received in the accommodation groove 902.

The left cover member 960 is detachable from and attachable to the upper cover 900. The left cover member 960 covers a lower portion of the left insulator 780 to support the left insulator 780 in a state where the left cover member 960 is attached to the upper cover 900. The left cover member 960 includes a front wall 961, a lower wall 963, a rear wall 966, a left wall 968, and a right wall 965. The left wall 968 is connected to left ends of the front wall 961, the lower wall 963, and the rear wall 966. The left wall 968 has an upper portion higher than upper ends of the front wall 961 and the rear wall 966. The right wall 965 is connected to right ends of the front wall 961, the lower wall 963, and the rear wall 966. The right wall 965 has an upper portion 982 (see FIG. 7) higher than upper ends of the front wall 961 and the rear wall 966. Details of the front wall 961, the rear wall 966 and the right wall 965 will be described later.

The front wall 961 is in contact with the fixing hole 905 and a lower portion of the front surface of the left insulator 780 received in the left supporting recess 940 in a state where the left cover member 960 is attached to the upper cover 900. The lower wall 963 is disposed so as not to be overlapped with the left insulator 780 as viewed in the rightward/leftward direction, and is in contact with the lower surface of the left insulator 780. The rear wall 966 is in contact with a lower portion of the rear surface 780C of the left insulator 780. The right wall 965 is positioned between the left end of the heat roller 710 and the left insulator 780, and is in contact with the right surface 780B of the left insulator 780. The left wall 968 is in contact with the left surface 780A of the left insulator 780. That is, the left wall 968 is overlapped with the left insulator 780 as viewed in the rightward/leftward direction, thereby preventing the left insulator 780 from moving leftward. In the following description, it is assumed that the left cover member 960 is attached to the upper cover 900 unless otherwise noted. Incidentally, the left cover member 960 is an example of a restriction member, the left wall 968 is an example of another side wall of the restriction member, and the lower wall 963 is an example of a connecting wall. The left cover member 960 is also an example of a cover member.

The front wall 961 is bent into L-shape as viewed in the rightward/leftward direction. The front wall 961 includes a first plate portion 961A extending in the upward/downward direction and a second plate portion 961B extending frontward from an upper end of the first plate portion 961A. The first plate portion 961A covers the front surface of the left insulator 780. The second plate portion 961B contacts the lower surface 901 of the upper cover 900. The second plate portion 961B has a through-hole 962 formed at a position overlapped with the fixing hole 905 of the upper cover 900 as viewed in the upward/downward direction.

Figure 6:
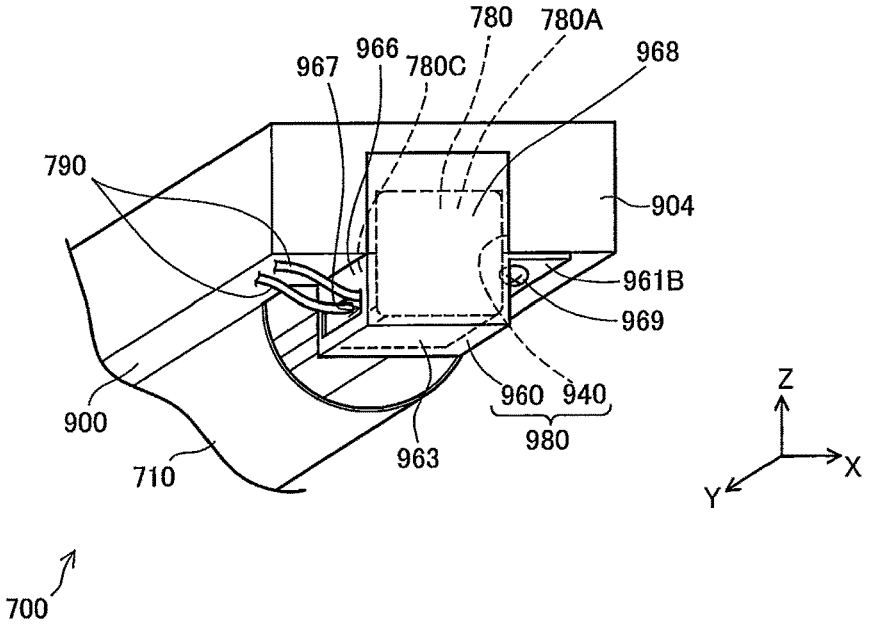
FIG. 6 is a perspective view, as viewed from the left side, illustrating the left side portion of the upper cover, the heat roller, and the left cover member attached to the upper cover in the fixing device according to the embodiment.

The rear wall 966 has an opening 967, which is a through-hole penetrating the rear wall 966 in the frontward/rearward direction. As illustrated in FIG. 6, the opening 967 is positioned to be overlapped with base ends of the left cords 790 extending from the rear surface 780C of the left insulator 780 as viewed in the frontward/rearward direction.

Figure 7:
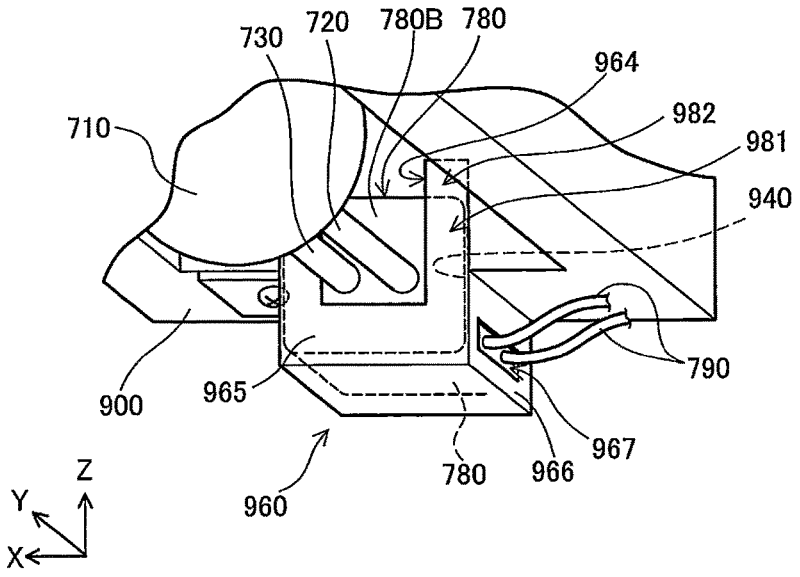
FIG. 7 is a perspective view, as viewed from the right side, illustrating the left side portion of the upper cover, the heat roller, and the left cover member attached to the upper cover in the fixing device according to the embodiment.

The right wall 965 has an opening 964. The opening 964 penetrates the right wall 965 in the rightward/leftward direction, and has a notched shape with an upper side open. As illustrated in FIG. 7, the opening 964 is overlapped with the left insulator 780 as viewed in the rightward/leftward direction. Further, the opening 964 is positioned to be overlapped with the first heater 720 and the second heater 730 as viewed in the rightward/leftward direction.

The opening 964 has a dimension in the frontward/rearward direction smaller than a dimension in the frontward/rearward direction of the left insulator 780. Further, the opening 964 has a dimension in the upward/downward direction smaller than a dimension in the upward/downward direction of the left insulator 780. With this structure, a portion 981 of the right wall 965 ambient to the opening 964 is overlapped with the left insulator 780 (i.e., the right surface 780B of the left insulator 780) as viewed in the rightward/leftward direction, thereby preventing the left insulator 780 from being moved rightward. Incidentally, the right wall 965 is an example of one side wall of the restriction member, and the opening 964 is an example of a recessed portion.

The upper portion 982 of the right wall 965 is positioned higher than an upper end of the left insulator 780, and is overlapped with an upper portion of the left supporting recess 940 of the upper cover 900 as viewed in the rightward/leftward direction.

The left cover member 960 is attached to the upper cover 900 from below. In the state of attachment of the left cover member 960 to the upper cover 900, the left cords 790 extending from the rear surface 780C of the left insulator 780 is drawn outside the rear wall 966 through the opening 967 of the rear wall 966. After the left cover member 960 has been attached to the upper cover 900, the left cover member 960 is fixed to the upper cover 900 by a screw 969 extending through the through-hole 962 and threadingly engaged with the fixing hole 905.

The left insulator 780 is supported such that the upper portion of the left insulator 780 is received in the left supporting recess 940 of the upper cover 900 and the lower portion of the left insulator 780 is covered by the left cover member 960. That is, the left insulator 780 is supported by being positioned between the upper cover 900 and the left cover member 960 in the upward/downward direction. Therefore, the left supporting recess 940, the portion of the upper cover 900 ambient to the left supporting recess 940, and the left cover member 960 constitute in combination a support portion 980 (see FIG. 6) for supporting the left insulator 780.

The fixing device 700 is attached to and detached from the housing 100. The fixing device 700 is moved in the attachment direction DR2 (see FIG. 4) with respect to the housing 100 to be attached to the housing 100. Specifically, for attaching the fixing device 700 to the housing 100, the fixing device 700 is moved in the attachment direction DR2 with respect to the housing 100 so as to be fitted with a positioning member (not illustrated) provided in the housing 100. By the fitting, the fixing device 700 is subjected to positioning relative to the housing 100 to complete its attachment to the housing 100.

Process for replacing the first heater 720 and the second heater 730 with new heaters will next be described. The replacing process is performed when at least one of the first heater 720 and the second heater 730 reaches the end of its service life.

In the replacing process, first, the fixing device 700 is removed from the housing 100. Then, the right cover member 950 and the left cover member 960 are detached from the upper cover 900 of the fixing device 700 that has been removed from the housing 100. The detachment of the right cover member 950 and the left cover member 960 is performed in a state where the upper portion of the right insulator 760 is received in the right supporting recess 930 and the upper portion of the left insulator 780 is received in the left supporting recess 940.

As illustrated in FIG. 3, the right cover member 950 is detached from the upper cover 900, after removal of the screw 959 (see FIG. 4), such that the right cover member 950 is not overlapped with the right insulator 760 as viewed in the rightward/leftward direction. Further, as illustrated in FIG. 5, the left cover member 960 is detached from the upper cover 900, after removal of the screw 969 (see FIG. 6), such that the left cover member 960 is not overlapped with the left insulator 780 as viewed in the rightward/leftward direction.

Next, the first heater 720 and the second heater 730 are separated from the upper cover 900. As described above, the right insulator 760 is movable in the rightward/leftward direction while the upper portion of the right insulator 760 is received in the right supporting recess 930, and the left insulator 780 is movable in the rightward/leftward direction while the upper portion of the left insulator 780 is received in the left supporting recess 940. Therefore, the first heater 720 and the second heater 730 are made movable in the rightward/leftward direction with respect to the upper cover 900, and for example, are separated from the upper cover 900 to a position leftward of the upper cover 900.

After the separation of the first heater 720 and the second heater 730, new first heater 720 and second heater 730 positioned leftward of the upper cover 900 are moved rightward for the attachment to the upper cover 900. After the attachment of the new first heater 720 and the second heater 730, the right cover member 950 and the left cover member 960 are attached to the housing 100, and the fixing device 700 is attached to the housing 100. Thus, replacing process for the first heater 720 and the second heater 730 is completed.

Incidentally, in the present embodiment, the left cover member 960 prevents the movement of the left insulator 780 in both the rightward direction and the leftward direction, whereas the right cover member 950 restricts the movement of the right insulator 760 only in the rightward direction. Therefore, detachment of the first heater 720 and the second heater 730 from the right side of the upper cover 900 is performed by removing both the left cover member 960 and the right cover member 950 from the upper cover 900. On the other hand, when the first heater 720 and the second heater 730 are detached from the left side of the upper cover 900, only the left cover member 960 needs to be detached from the upper cover 900.

According to the embodiment, the left cover member 960 includes the right wall 965 and the left wall 968. Since the right wall 965 prevents rightward movement of the left insulator 780 and the left wall 968 prevents leftward movement of the left insulator 780, displacement of the left insulator 780 in the rightward/leftward direction can be restrained in the case where the left cover member 960 is attached to the upper cover 900. Thus, displacement of the first heater 720 and the second heater 730 in the rightward/leftward direction can be restrained.

Further, the left insulator 780 is positioned at the position not overlapped with the upper cover 900 as viewed in the rightward/leftward direction in the state where the left insulator 780 is received in the left supporting recess 940. Therefore, the first heater 720 and the second heater 730 can be easily detached from and attached to the upper cover 900 with the movement of the first heater 720 and the second heater 730 in the rightward/leftward direction after the left cover member 960 is moved to the position not overlapped with the left insulator 780 as viewed in the rightward/leftward direction. Accordingly, the first heater 720 and the second heater 730 need not to be moved toward directions other than the rightward/leftward direction during attachment or detachment of the first heater 720 and the second heater 730 to or from the upper cover 900. Consequently, degradation in efficiency for attachment or detachment of first heater 720 and the second heater 730 to or from the upper cover 900 can be restrained in comparison with a case where the movement of the first heater 720 and the second heater 730 in the leftward direction is restricted by the upper cover 900, for example, the upper cover 900 has a wall portion provided leftward of the left insulator 780.

Further, according to the embodiment, the left cover member 960 includes the lower wall 963. Therefore, downward displacement of the left insulator 780 can be restrained in the state where the left cover member 960 is attached to the upper cover 900, thereby preventing downward displacement of the first heater 720 and the second heater 730.

Further, according to the embodiment, in the attachment state of the left cover member 960 to the upper cover 900, the right wall 965 of the left cover member 960 has the upper portion 982 overlapped with the upper portion of the left supporting recess 940 of the upper cover 900 as viewed in the rightward/leftward direction. This structure can reduce influence of radiation heat from the first heater 720 and the second heater 730 to the portion of the upper cover 900 above the left supporting recess 940 in comparison with a case in which the right wall 965 does not include the upper portion 982.

Further, according to the embodiment, the left end portion of the right insulator 760 is positioned inside the heat roller 710 in the state where the right insulator 760 is received in the right supporting recess 930. Therefore, length in the rightward/leftward direction of the fixing device 700 can be smaller than the length of a comparative structure where the entire right insulator 760 is positioned outside the heat roller 710.

Further, according to the embodiment, the first hook 954 and the second hook 956 are positioned at the outer surface 951B of the right wall 951 of the right cover member 950. Therefore, labor for engaging the right cords 770 can be performed using a space facing the outer surface 951B of the right wall 951 of the right cover member 950 instead of a space between the heat roller 710 and the right wall 951 of the right cover member 950. Accordingly, degradation in efficiency for engaging the right cords 770 to the right cover member 950 can be restrained in comparison with a case in which the first hook 954 and the second hook 956 are positioned at the inner surface 951A of the right wall 951 of the right cover member 950.

While the description has been made in detail with reference to the embodiment(s) thereof, it would be apparent to those skilled in the art that many modifications and variations may be made therein without departing from the spirit of the disclosure. For example, modifications described below are conceivable.

According to the above-described embodiment, as illustrated in FIG. 6, a lower end of the right wall 965 is positioned within an outer profile of the heat roller 710 as viewed in the rightward/leftward direction. However, a different structure may be employed. A fixing device 700A according to a first modification will be described wherein like parts and components are designated by the same reference numerals as those shown in the depicted embodiment to avoid duplicating description.

Figure 8:
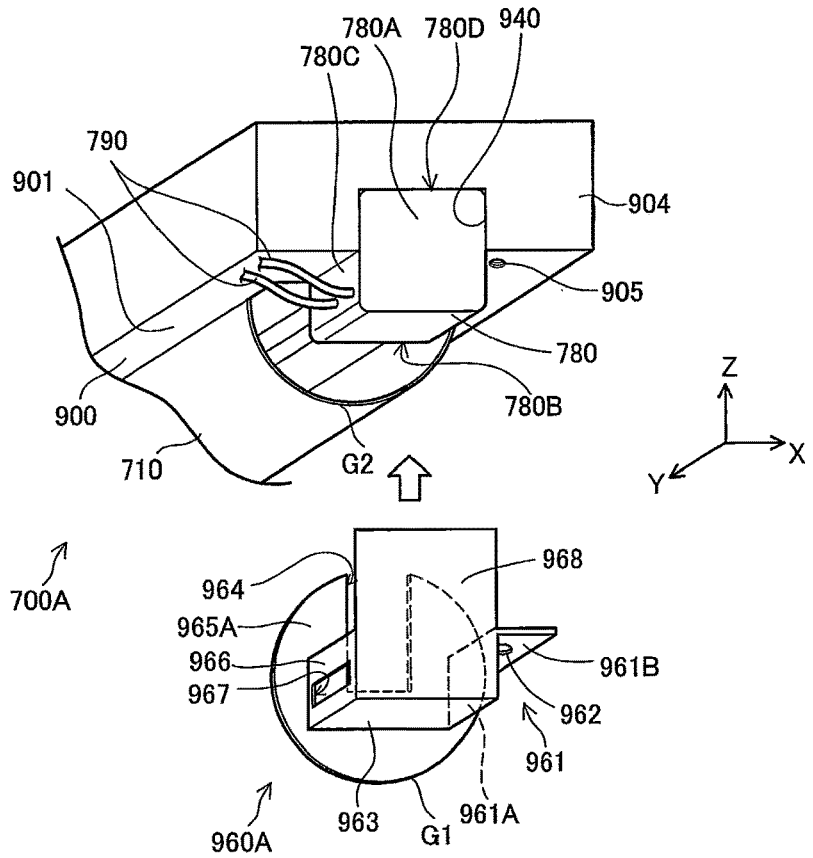
FIG. 8 is a perspective view, as viewed from a left side, illustrating a left side portion of an upper cover, a heat roller, a left insulator, and a left cover member detached from the upper cover in a fixing device according to a first modification.
Figure 9:
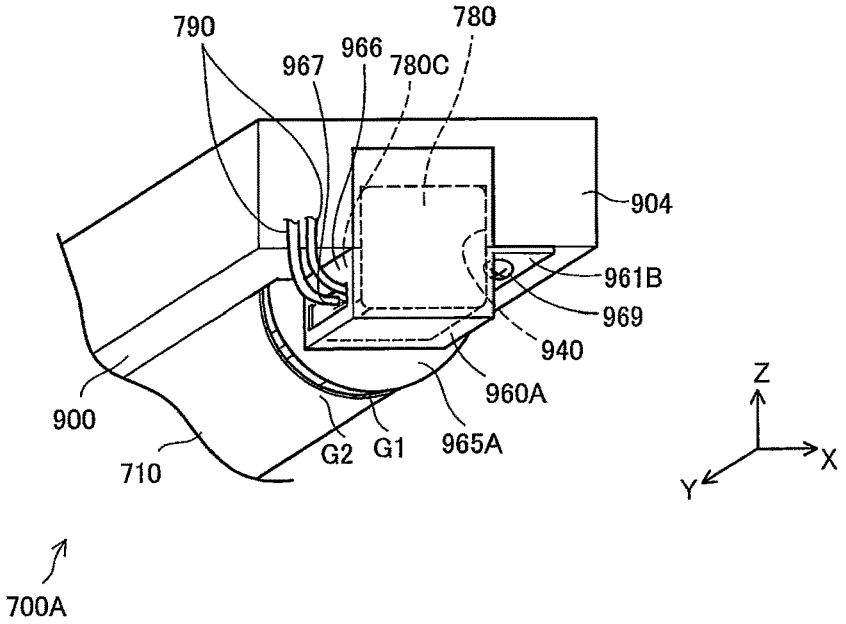
FIG. 9 is a perspective view, as viewed from the left side, illustrating the left side portion of the upper cover, the heat roller, and the left cover member attached to the upper cover in the fixing device according to the first modification.

As illustrated in FIGS. 8 and 9, in the fixing device 700A according to the first modification, a right wall 965A of a left cover member 960A has a generally circular shape as viewed in the rightward/leftward direction. The right wall 965A of the left cover member 960A has an outer profile G1 positioned radially outward of an outer profile G2 of the heat roller 710 as viewed in the rightward/leftward direction except the opening 964 in the state of attachment of the left cover member 960A to the upper cover 900.

With such positional relationship between the outer profile G1 and the outer profile G2, the outer peripheral end portion of the right wall 965A of the left cover member 960A except the opening 964 can moderate application of radiation heat from the first heater 720 and the second heater 730 to the left cords 790, in comparison with a structure in which at least a portion of the outer profile of the right wall 965A except the opening 964 is positioned radially inward of the outer profile G2 of the heat roller 710.

Further, according to the above-described embodiment, the left cover member 960 covering the lower portion of the left insulator 780 is the example of the restriction member, but the restriction member is not limited to the left cover member 960. Specifically, an engagement member 990 which will not cover the lower portion of the left insulator 780 may be an example of a restriction member. A fixing device 700B according to a second modification will be described wherein like parts and components are designated by the same reference numerals as those shown in the depicted embodiment to avoid duplicating description.

Figure 10:
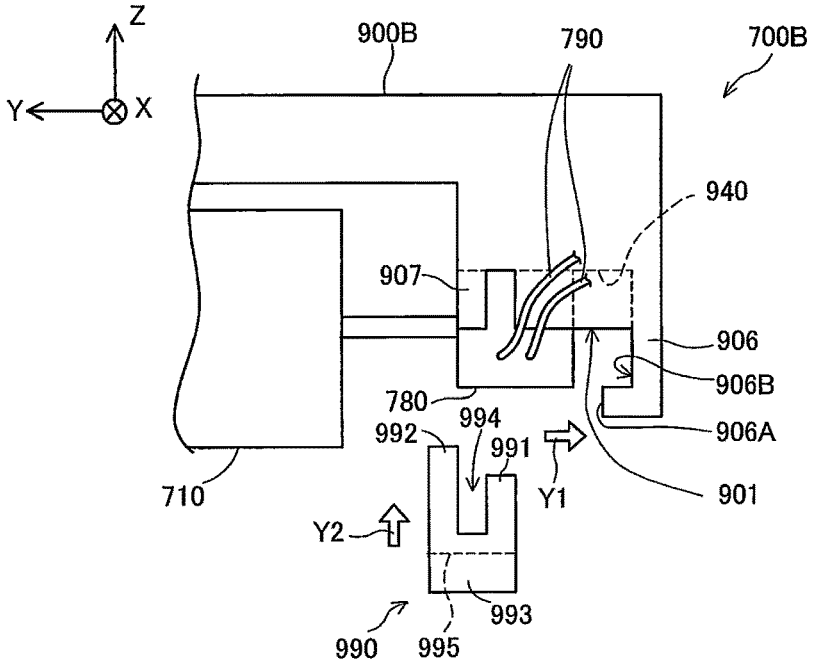
FIG. 10 is a rear side view illustrating a left side portion of an upper cover, a heat roller, a left insulator and an engagement member detached from the upper cover in a fixing device according to a second modification.
Figure 11:
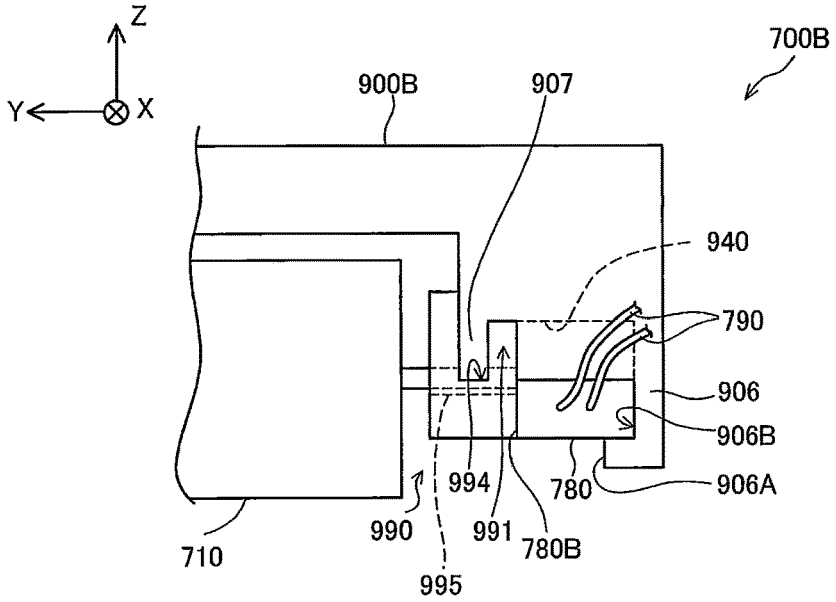
FIG. 11 is a rear side view illustrating the left side portion of the upper cover, the heat roller, the left insulator and the engagement member attached to the upper cover in the fixing device according to the second modification.

As illustrated in FIGS. 10 and 11, in the fixing device 700B according to the second modification, a lower surface 901 of an upper cover 900B has a left end portion provided with a fitting portion 907 and a wall portion 906. The fitting portion 907 is positioned at a right end of a left supporting recess 940, and is in a form of a protrusion protruding downward. The wall portion 906 is positioned leftward of the left supporting recess 940. Thus, in the fixing device 700B according to the second modification, the left supporting recess 940 is not open to the left end surface 904 of the upper cover 900B. The fitting portion 907 is an example of a protruding portion.

An accommodation hole 906B is formed at a right end surface 906A of the wall portion 906. The accommodation hole 906B is recessed leftward from the wall portion 906, and is in communication with the left supporting recess 940. The accommodation hole 906B receives the left end portion of the left insulator 780. Specifically, after the left insulator 780 is received in the left supporting recess 940, the left insulator 780 is moved in a direction indicated by an arrow Y1, that is, leftward. Accordingly, the left end portion of the left insulator 780 is received in the accommodation hole 906B as illustrated in FIG. 11, and the left surface 780A of the left insulator 780 is in contact with the wall portion 906. Consequently, leftward displacement of the left insulator 780 is restrained by the wall portion 906.

The engagement member 990 is attachable to and detachable from the upper cover 900B, and contacts the right surface 780B of the left insulator 780 to support the left insulator 780 in a state where the engagement member 990 is attached to the upper cover 900B. As illustrated in FIG. 10, the engagement member 990 includes a left wall 991, a lower wall 993, and a right wall 992, and is formed with an opening 995 and a fitting hole 994. The right wall 992 has an upper portion positioned higher than an upper end of the left wall 991. The opening 995 is formed at the left wall 991 and the right wall 992 such that the opening 995 is overlapped with the first heater 720 and the second heater 730 in the attachment state of the engagement member 990 to the upper cover 900B, and has a notched shape whose top end is open.

The fitting hole 994 (an example of a recess) is positioned between the left wall 991 and the right wall 992 in the rightward/leftward direction, and is recessed downward. After the left end portion of the left insulator 780 is received in the accommodation hole 906B, the engagement member 990 is moved in a direction indicated by an arrow Y2 (upward) relative to the upper cover 900B, so that the fitting hole 994 of the engagement member 990 is brought into fitting engagement with the fitting portion 907 of the upper cover 900B. In the state of the fitting engagement, the left wall 991 is positioned between the heat roller 710 and the left insulator 780, and is in contact with the right surface 780B of the left insulator 780 received in the accommodation hole 906B. That is, the left wall 991 is positioned to be overlapped with the left insulator 780 (i.e., the right surface 780B of the left insulator 780) as viewed in the rightward/leftward direction. Thus, rightward displacement of the left insulator 780 is restrained. In this case, the left wall 991 is an example of the one side wall.

In the fixing device 700B according to the second modification, the engagement member 990 is fixed to the upper cover 900B by way of fitting engagement therebetween. Therefore, degradation in efficiency for attaching and detaching the first heater 720 and the second heater 730 to and from the upper cover 900B can be restrained compared to a case in which a screw is used for fixing the engagement member 990 to the upper cover 900B.

According to the above-described embodiment, the first hook 954 and the second hook 956 are positioned at the outer surface 951B of the right wall 951 of the right cover member 950. However, another structure is conceivable. For example, the first hook 954 and the second hook 956 may be positioned at the inner surface 951A of the right wall 951, or at the right end surface 903 of the upper cover 900.

According to the above-described embodiment, the left end portion of the right insulator 760 is positioned inside the heat roller 710 in the state where the right insulator 760 is received in the right supporting recess 930, but the layout of the right insulator 760 is not limited to this. For example, the entire right insulator 760 is positioned outside the heat roller 710 in the received state of the right insulator 760 in the right supporting recess 930.

According to the above-described embodiment, the portion of the right wall 965 of the left cover member 960 is overlapped with the portion of the upper cover 900 ambient to the left supporting recess 940 as viewed in the rightward/ leftward direction in the state where the left cover member 960 is attached to the upper cover 900, but a different structure is conceivable. For example, the right wall 965 of the left cover member 960 may be positioned so as not to be overlapped with the portion of the upper cover 900 ambient to the left supporting recess 940 as viewed in the rightward/leftward direction.

According to the above-described embodiment, the lower wall 963 is the example of the connecting wall. However, the connecting wall is not limited to the lower wall 963. For example, the front wall 961 or the rear wall 966 may be an example of the connecting wall. Further, the connecting wall does not necessarily contact the left insulator 780 and may just cover the left insulator 780.

According to the above-described embodiment, the left cover member 960 includes the left wall 968, but other structure different from the depicted configuration may be employed. For example, the left wall 968 may not be provided at the left cover member 960.

The configuration of the printer 10 depicted in the above-described embodiment is merely an example and various modification(s) is conceivable. In the above-described embodiment, the printer 10 in which the fixing device according to the present disclosure is employed uses toner of a single color (black color). Alternatively, a printer using toner of a different color or a printer using toner of multiple colors may be employed as the printer 10.

Further, in addition to the printer 10, the fixing device according to the present disclosure can be employed in a copying machine, a facsimile machine, and a multi-function device.

Further, according to the above-described embodiment, the halogen heater is exemplified as the heater of the fixing device. However, other type of heater such as an infrared heater or a carbon heater is available. On the other hand, a heater in which the insulators are not required, such as a ceramic heater or an IH heater cannot be used for the fixing device according to the present disclosure.

What is claimed is:

1. A fixing device comprising:

a rotary body having a hollow cylindrical shape and a rotational axis extending in a first direction;

a heater positioned inside the rotary body and having a tubular shape, the heater extending in the first direction and having one end and another end;

a first power supply cord having one end portion connected to the one end of the heater;

a first insulator configured to hold both the one end of the heater and the one end portion of the first power supply cord, the first insulator having a plurality of outer peripheral surfaces including one surface through which the one end of the heater is inserted;

a second power supply cord having one end portion connected to the another end of the heater;

a second insulator configured to hold both the another end of the heater and the one end portion of the second power supply cord, the second insulator having a plurality of outer peripheral surfaces including:

a first surface through which the another end of the heater is inserted; and a second surface positioned opposite to the first surface with respect to a connecting portion between the another end of the heater and the second power supply cord;

a support frame including:

a first support portion supporting the first insulator, the first support portion being configured to support the plurality of outer peripheral surfaces of the first insulator except the one surface; and a second support portion supporting the second insulator, the second support portion being configured to support the plurality of outer peripheral surfaces of the second insulator except both the first surface and the second surface; and a restriction member having one side wall positioned between the rotary body and the one surface of the first insulator, the restriction member being configured to be detachably attached to the support frame and to restrict movement of the first insulator in the first direction, the one side wall having at least a portion overlapped with the one surface as viewed in the first direction.

2. The fixing device according to claim 1, wherein the restriction member is fixed to the support frame by a screw.

3. The fixing device according to claim 1, wherein the support frame further includes a protruding portion protruding in a direction perpendicular to the first direction, and wherein the restriction member has a recess configured to be engaged with the protruding portion.

4. The fixing device according to claim 1, wherein the first insulator further has another surface parallel to the one surface, and wherein the restriction member further has another side wall contacting the another surface.

5. The fixing device according to claim 4, wherein the restriction member further has a connecting wall connecting the one side wall and the another side wall, the connecting wall contacting the first insulator.

6. The fixing device according to claim 4, wherein the first support portion has an entire portion positioned outside of the rotary body, the first support portion having a part facing the rotary body and out of contact with the first insulator, and wherein the one side wall is positioned between the rotary body and the first support portion in the first direction, the one side wall having at least a portion overlapped with the part of the first support portion as viewed in the first direction.

7. The fixing device according to claim 6, wherein the one side wall is formed with a recessed portion with which the heater is fitted, the one side wall having an outer profile, wherein the rotary body has one end portion defining an outer profile, and wherein the outer profile of the one side wall is positioned outward of the outer profile of the rotary body in a radial direction of the rotary body except the recessed portion.

8. The fixing device according to claim 1, wherein the first insulator further has another surface parallel to the one surface, wherein the support frame further has a wall portion configured to contact the another surface, and wherein the one side wall is configured to contact the one surface in a state where the wall portion is in contact with the another surface.

9. The fixing device according to claim 1, wherein the first insulator further has:

another surface parallel to the one surface; and a connecting surface connecting the one surface and the another surface, and wherein the first power supply cord extends outward from the connecting surface in a radial direction of the rotary body.

10. The fixing device according to claim 1, wherein the second insulator has a portion positioned inside the rotary body.

11. The fixing device according to claim 1, further comprising another restriction member having a side wall positioned opposite to the rotary body with respect to the second insulator, the another restriction member being configured to be detachably attached to the support frame and to restrict movement of the second insulator in the first direction, the side wall of the another restriction member having at least a portion overlapped with the second surface as viewed in the first direction.

12. The fixing device according to claim 11, wherein the another restriction member includes a hook provided at the side wall and holding the second power supply cord.

13. The fixing device according to claim 12, wherein the side wall of the another restriction member has an inner surface contacting the second surface of the second insulator and an outer surface opposite to the inner surface, and wherein the hook is provided at the outer surface.

14. The fixing device according to claim 13, wherein the rotary body is rotatable to define a second direction perpendicular to the first direction, and wherein the hook is positioned at a downstream side of the second insulator in the second direction.

15. The fixing device according to claim 11, wherein the second power supply cord extends in the first direction from the second surface, and wherein the side wall of the another restriction member is formed with an opening through which the second power supply cord extends.

16. The fixing device according to claim 11, wherein the support frame includes a protrusion protruding in the first direction, and wherein the side wall of the another restriction member is formed with a hole with which the protrusion is fitted.

17. The fixing device according to claim 11, wherein the another restriction member is fixed to the support frame by a screw.

18. The fixing device according to claim 1, further comprising:

another heater positioned inside the rotary body and having a tubular shape, the another heater extending in the first direction and having one end and another end;

a third power supply cord having one end portion connected to the one end of the another heater; and a fourth power supply cord having one end portion connected to the another end of the another heater, wherein the first insulator is further configured to hold both the one end of the another heater and the one end portion of the third power supply cord, and wherein the second insulator is further configured to hold the another end of the another heater and the one end portion of the fourth power supply cord.

19. An image forming apparatus comprising:

a main frame; and a fixing device attached to the main frame, the fixing device comprising:

a rotary body having a hollow cylindrical shape and a rotational axis extending in a first direction;

a heater positioned inside the rotary body and having a tubular shape, the heater extending in the first direction and having one end and another end;

a first power supply cord having one end portion connected to the one end of the heater;

a first insulator configured to hold both the one end of the heater and the one end portion of the first power supply cord, the first insulator having a plurality of outer peripheral surfaces including one surface through which the one end of the heater is inserted;

a second power supply cord having one end portion connected to the another end of the heater;

a second insulator configured to hold both the another end of the heater and the one end portion of the second power supply cord, the second insulator having a plurality of outer peripheral surfaces including:

a first surface through which the another end of the heater is inserted; and a second surface positioned opposite to the first surface with respect to a connecting portion between the another end of the heater and the second power supply cord;

a support frame including:

a first support portion supporting the first insulator, the first support portion being configured to support the plurality of outer peripheral surfaces of the first insulator except the one surface; and a second support portion supporting the second insulator, the second support portion being configured to support the plurality of outer peripheral surfaces of the second insulator except both the first surface and the second surface; and a restriction member having one side wall positioned between the rotary body and the one surface of the first insulator, the restriction member being configured to be detachably attached to the support frame and to restrict movement of the first insulator in the first direction, the one side wall having at least a portion overlapped with the one surface as viewed in the first direction.

* * * * *